US008113795B1

(12) United States Patent
Vanell

(10) Patent No.: US 8,113,795 B1
(45) Date of Patent: Feb. 14, 2012

(54) SYSTEM WITH COUPLING MECHANISMS

(76) Inventor: David Vanell, Palm Harbor, FL (US)

( * ) Notice: Subject to any disclaimer, the term of this patent is extended or adjusted under 35 U.S.C. 154(b) by 1063 days.

(21) Appl. No.: 11/983,001

(22) Filed: Nov. 6, 2007

(51) Int. Cl.
*F04B 35/00* (2006.01)

(52) U.S. Cl. ..... 417/360; 417/364

(58) Field of Classification Search ..... 417/360, 417/364; 464/901
See application file for complete search history.

(56) References Cited

U.S. PATENT DOCUMENTS 4,504,164 A * 3/1985 Bien ..... 403/109.3
4,597,203 A * 7/1986 Middleton ..... 37/241
6,086,479 A * 7/2000 Khariton ..... 464/179
6,116,864 A * 9/2000 Veser et al. ..... 417/364
6,347,928 B1 * 2/2002 Renaud ..... 417/360
6,644,264 B2 11/2003 Shoemaker
7,614,855 B2 * 11/2009 Cook ..... 417/363

* cited by examiner

*Primary Examiner* — Charles Freay

(57) ABSTRACT

An internal combustion engine has a base. The base has exterior and interior faces. The exterior face has a starter. The starter initiates rotation about a fixed horizontal major axis of rotation. The interior face has a power output shaft. The power output shaft is adapted to be rotated about a fixed horizontal axis of rotation coextensive with the major axis of rotation. The power output shaft has a free end. The free end constitutes a power take off shaft. A driven device has a power input shaft. The power input shaft is mounted for rotation about a fixed horizontal major axis of rotation of rotation coextensive with the horizontal major axis of rotation of the power output shaft. A coupling member couples the power input shaft and power output shaft.

1 Claim, 3 Drawing Sheets

FIG 1
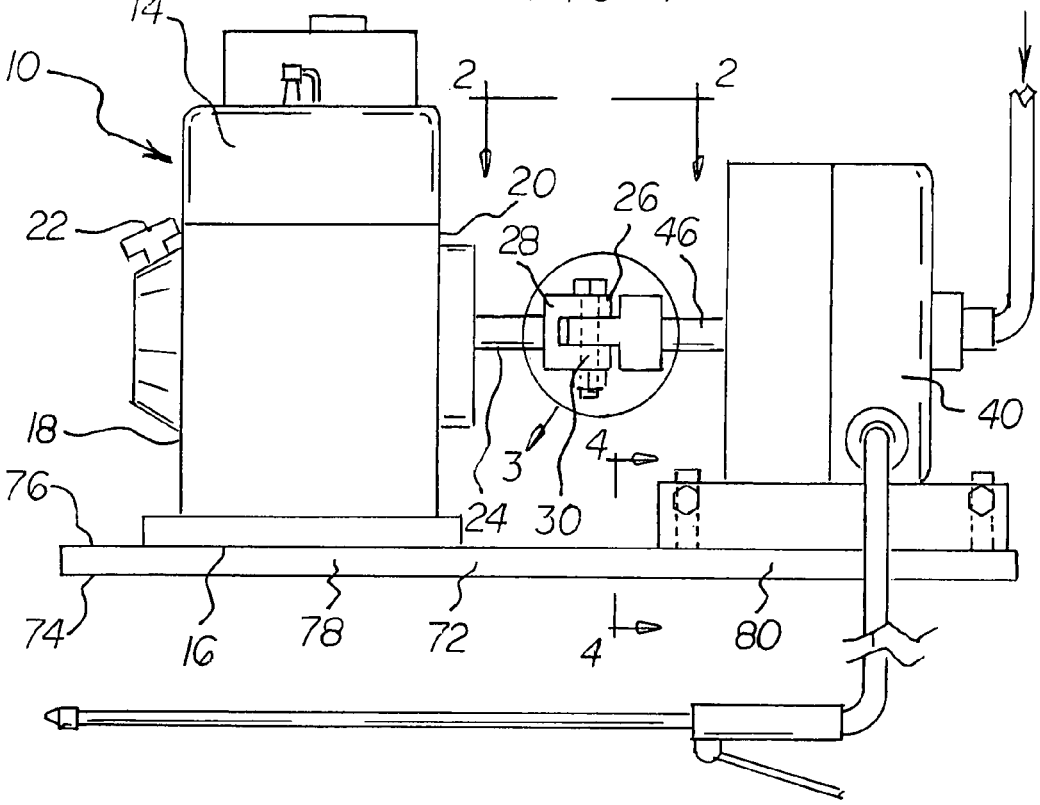
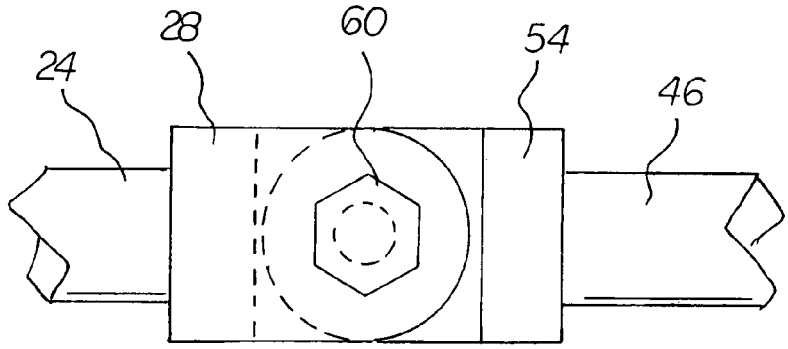
FIG 2

FIG 5
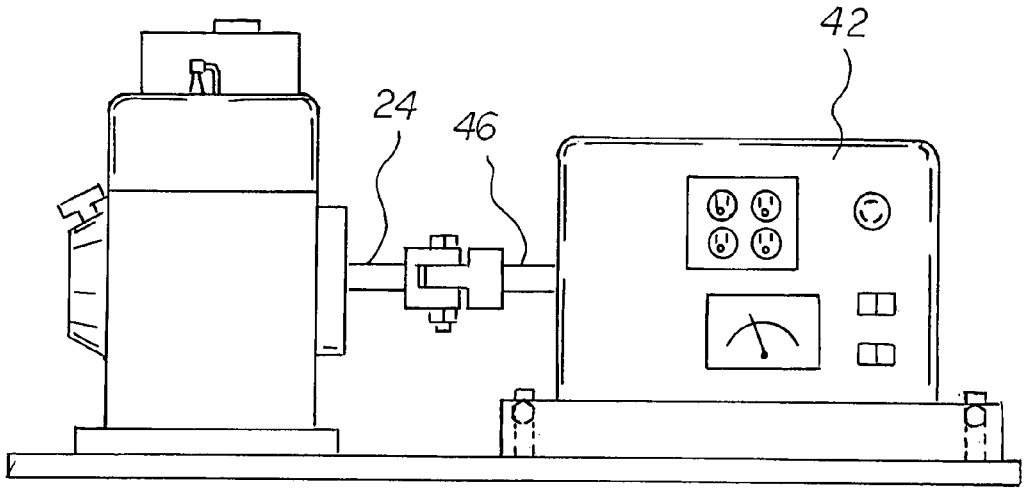
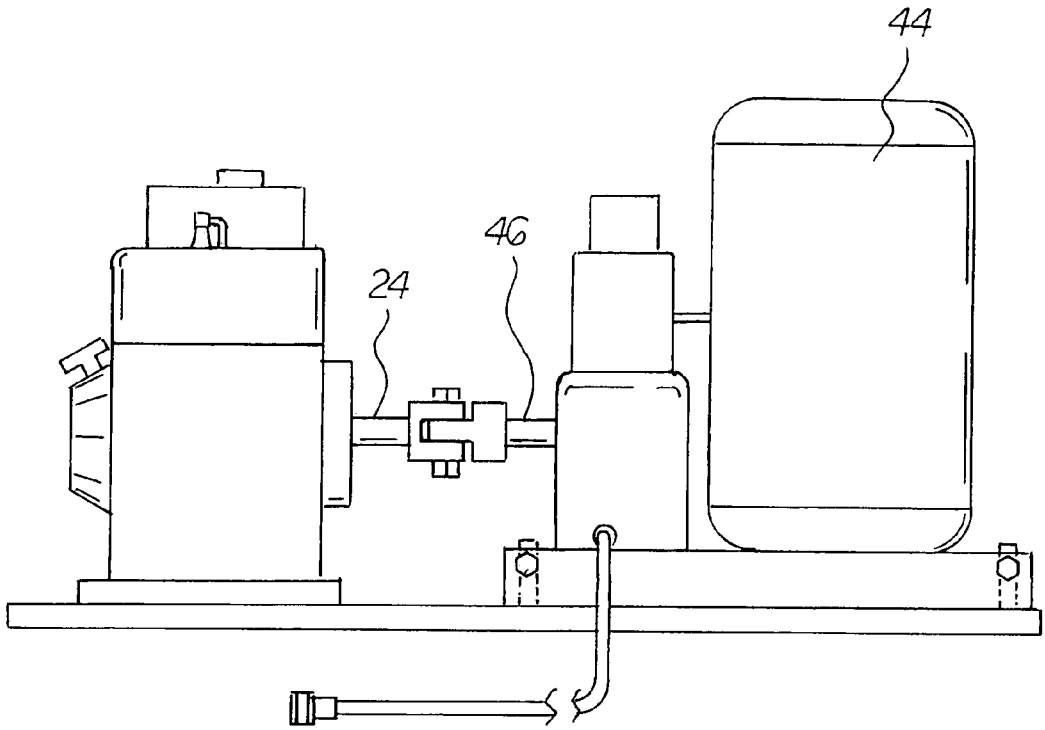
FIG 6

SYSTEM WITH COUPLING MECHANISMS

BACKGROUND OF THE INVENTION

1. Field of the Invention

The present invention relates to a power coupling system and more particularly pertains to facilitating the powering of a pressure sprayer, generator and air compressor by an internal combustion engine in a safe, convenient and economical manner.

2. Description of the Prior Art

The use of internal combustion engine systems of known designs and configurations is known in the prior art. More specifically, internal combustion engine systems of known designs and configurations previously devised and utilized for the purpose of facilitating power through known methods and apparatuses are known to consist basically of familiar, expected, and obvious structural configurations, notwithstanding the myriad of designs encompassed by the crowded prior art which has been developed for the fulfillment of countless objectives and requirements.

By way of example, U.S. Pat. No. 6,644,264 issued Nov. 11, 2003 to Shoemaker relates to a Vertical Shaft Internal Combustion Engine With Overhead Power Take-Off.

While this devices fulfills its respective, particular objectives and requirements, the aforementioned patent does not describe a power coupling system with a horizontal axis and universal base that allows for facilitating the powering of a pressure sprayer, generator and air compressor by an internal combustion engine in a safe, convenient and economical manner.

In this respect, the power coupling system according to the present invention substantially departs from the conventional concepts and designs of the prior art, and in doing so provides an apparatus primarily developed for the purpose of facilitating the powering of, but not limited to, a pressure sprayer, generator, air compressor and the like by an internal combustion engine in a safe, convenient and economical manner.

Therefore, it can be appreciated that there exists a continuing need for a new and improved power coupling system which can be used for facilitating the powering of a pressure sprayer, generator and air compressor by an internal combustion engine in a safe, convenient and economical manner. In this regard, the present invention substantially fulfills this need.

SUMMARY OF THE INVENTION

In view of the foregoing disadvantages inherent in the known types of internal combustion engine systems of known designs and configurations now present in the prior art, the present invention provides an improved power coupling system. As such, the general purpose of the present invention, which will be described subsequently in greater detail, is to provide a new and improved power coupling system and method which has all the advantages of the prior art and none of the disadvantages.

To attain this, the present invention essentially comprises a power coupling system with a horizontal axis of rotation. First provided is an internal combustion engine. The internal combustion engine has a base. The base is provided below the internal combustion engine. The internal combustion engine has an exterior face. The exterior face is provided above the internal combustion engine. The internal combustion engine has an opposed interior face. The exterior face has a handle. The handle is adapted to be pulled by a user for rotation about a fixed horizontal major axis of rotation. In this manner the operation of the internal combustion engine is started. The interior face has a power output shaft. The power output shaft is adapted to be rotated about a fixed horizontal axis of rotation coextensive with the major axis of rotation in response to the operation of the internal combustion engine. The power output shaft has a free end. The free end is of an enlarged cylindrical configuration. The free end constitutes a power take off shaft. The free end is formed with laterally spaced plates. Provided through the plates are axially aligned circular apertures. The apertures are in axial alignment. The apertures have a common minor axis. The common minor axis of the apertures is provided perpendicular to and intersects the major axis of rotation.

A plurality of driven devices is provided. The driven devices are selected from the class of driven devices. The class of driven devices includes a pressure sprayer. The class of driven devices also includes a generator. The class of driven devices further includes an air compressor. Each driven device has a power input shaft. The power input shaft is mounted for rotation about a fixed horizontal major axis of rotation coextensive with the horizontal major axis of rotation of the power output shaft. The power input shaft has a free end. The free end has a flat projection. The flat projection is positionable between the plates of the power output shaft. The flat projection has an aperture. The aperture is in axial alignment with the apertures of the plates of the power output shaft. The power input shaft has an enlarged cylindrical section and of equal height from the base. The enlarged cylindrical section is provided adjacent to the projection. The enlarged cylindrical section has a diameter. The diameter of the enlarged cylindrical section of the power input shaft is essentially equal to the diameter of the enlarged cylindrical section of the power output shaft.

Further provided is a bolt. The bolt has a first end. The first end has an enlarged head. The bolt has a second end. The second end has male threads. The bolt has a central extent. The central extent is provided between the first and second ends. The central extent extends through the apertures of the power input shaft and power output shaft. In this manner the internal combustion engine and any of the driven devices are operatively coupled. The bolt has an associated nut. The nut has female threads. The female threads are removably positioned on the threads of the bolt. In this manner a user is allowed to selectively interchange the driven devices.

Provided last is a universal support base designed to accommodate the interchangeable driven devices. The support base is fabricated of a rigid metallic material. The support base has a horizontal bottom. The horizontal bottom is positionable upon a recipient surface. The support base has a horizontal top. The horizontal top is provided parallel with the bottom. The top of the support base has a first end. The first end is adapted to permanently receive and support the internal combustion engine. The axis of rotation of the power output shaft is provided at a fixed first distance from the top of the support base. The top of the support base has a laterally spaced second end. The second end is adapted to receive and support a preselected driven device. The axis of rotation of the power input shaft is provided at a fixed second distance from the flat top of the support base. The fixed second distance is equal to the first distance. The lateral distances between the internal combustion engine and the preselected driven device are such as to axial align the apertures of the power output shaft with the aperture of the power input shaft.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved power coupling system which has all of the advantages of the prior art internal combustion engine systems of known designs and configurations and none of the disadvantages.

It is another object of the present invention to provide a new and improved power coupling system which may be easily and efficiently manufactured and marketed.

It is further object of the present invention to provide a new and improved power coupling system which is of durable and reliable constructions.

An even further object of the present invention is to provide a new and improved power coupling system which is susceptible of a low cost of manufacture with regard to both materials and labor, and which accordingly is then susceptible of low prices of sale to the consuming public, thereby making such power coupling system economically available to the buying public.

Even still another object of the present invention is to provide a power coupling system for facilitating the powering of a pressure sprayer, generator and air compressor by an internal combustion engine in a safe, convenient and economical manner.

Lastly, it is an object of the present invention to provide a new and improved power coupling system. An internal combustion engine has a base. The base has exterior and interior faces. The exterior face has a starter. The starter initiates rotation about a fixed horizontal major axis of rotation. The interior face has a power output shaft. The power output shaft is adapted to be rotated about a fixed horizontal axis of rotation coextensive with the major axis of rotation. The power output shaft has a free end. The free end constitutes a power take off shaft. A driven device has a power input shaft. The power input shaft is mounted for rotation about a fixed horizontal major axis of rotation coextensive with the horizontal major axis of rotation of the power output shaft. A coupling member couples the power input shaft and power output shaft.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated the primary preferred embodiment of the present invention along with various alternate embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a front elevational view of a power coupling system illustrating an internal combustion engine powering a pressure sprayer constructed in accordance with the principles of the present invention.

FIG. 2 is a plan view of a portion of the system taken at line 2-2 of FIG. 1.

FIGS. 5 and 6 are front elevational views similar to FIG. 1 but illustrating the internal combustion engine powering a generator and an air compressor, respectively.

The same reference numerals refer to the same parts throughout the various Figures.

DESCRIPTION OF THE PREFERRED EMBODIMENT

Figure 3:
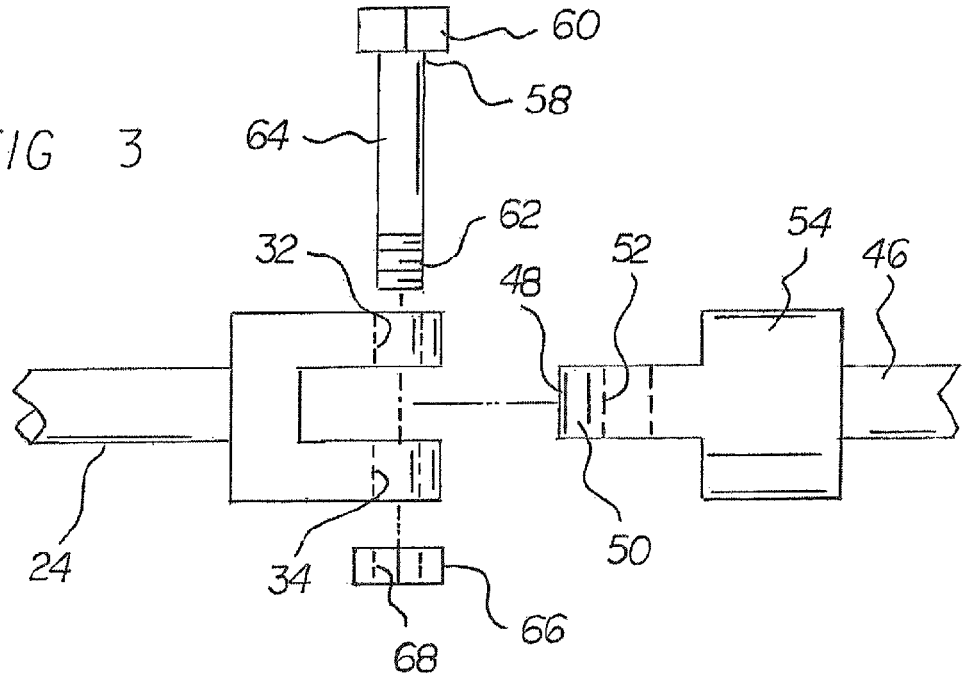
FIG. 3 is an exploded front elevational view taken at circle 3 of FIG. 1.
Figure 4:
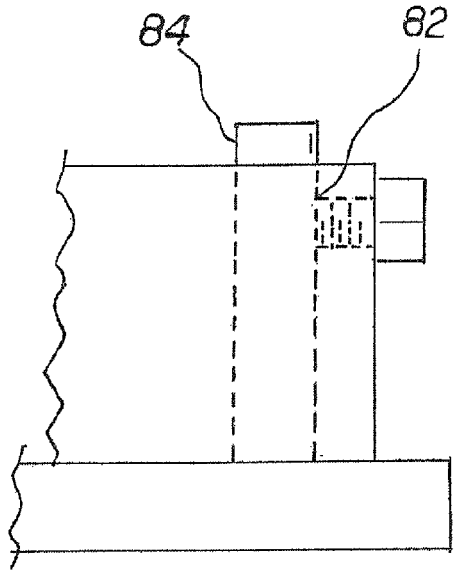
FIG. 4 is a cross sectional view taken at line 4-4 of FIG. 1.

With reference now to the drawings, and in particular to FIG. 1 thereof, the preferred embodiment of the new and improved power coupling system embodying the principles and concepts of the present invention and generally designated by the reference numeral 10 will be described.

The present invention, the power coupling system 10 on a horizontal axis is comprised of a plurality of components. Such components in their broadest context include an internal combustion engine, a driven device, a coupling member and a universal base. Such components are individually configured and correlated with respect to each other so as to attain the desired objective.

First provided is an internal combustion engine 14. The internal combustion engine has a base 16. The base is provided below the internal combustion engine. The internal combustion engine has an exterior face 18. The exterior face is provided above the internal combustion engine. The internal combustion engine has an opposed interior face 20. The exterior face has a starter illustrated as a handle 22 in the primary embodiment. The handle is adapted to be pulled by a user for rotation about a fixed horizontal major axis of rotation. In this manner the operation of the internal combustion engine is started. The interior face has a power output shaft 24. The power output shaft is adapted to be rotated about a fixed horizontal axis of rotation coextensive with the major axis of rotation in response to the operation of the internal combustion engine. The power output shaft has a free end 26. The free end is of an enlarged cylindrical configuration. The free end constitutes a power take off shaft. The free end is formed with laterally spaced plates 28, 30. Provided through the plates are axially aligned circular apertures 32, 34. The apertures are in axial alignment. The apertures have a common minor axis. The common minor axis of the apertures is provided perpendicular to and intersects the major axis of rotation.

A plurality of driven devices is provided. The driven devices are selected from the class of driven devices. The class of driven devices includes a pressure sprayer 40. The class of driven devices also includes a generator 42. The class of driven devices further includes an air compressor 44. Each driven device has a power input shaft 46. The power input shaft is mounted for rotation about a fixed horizontal major axis of rotation coextensive with the horizontal major axis of rotation of the power output shaft. The power input shaft has a free end 48. The free end has a flat projection 50. The flat projection is positionable between the plates of the power output shaft. The flat projection has an aperture 52. The aperture is in axial alignment with the apertures of the plates of the power output shaft and of equal height from the base. The power input shaft has an enlarged cylindrical section 54. The enlarged cylindrical section is provided adjacent to the projection. The enlarged cylindrical section has a diameter. The diameter of the enlarged cylindrical section of the power input shaft is essentially equal to the diameter of the enlarged cylindrical section of the power output shaft.

Further provided is a bolt 58. The bolt has a first end. The first end has an enlarged head 60. The bolt has a second end. The second end has male threads 62. The bolt has a central extent 64. The central extent is provided between the first and second ends. The central extent extends through the apertures of the power input shaft and power output shaft. In this manner the internal combustion engine and any of the driven devices are operatively coupled. The bolt has an associated nut 66. The nut has female threads 68. The female threads are removably positioned on the threads of the bolt. In this manner a user is allowed to selectively interchange the driven devices.

Provided last is a universal support base 72 designed to accommodate the interchangeable driven devices. The support base is fabricated of a rigid metallic material. The support base has a horizontal bottom 74. The horizontal bottom is positionable upon a recipient surface. The horizontal bottom surface is adapted to include wheels positionable on the recipient surface for repositioning the system. The support base has a horizontal top 76. The horizontal top is provided parallel with the bottom. The top of the support base has a first end 78. The first end is adapted to permanently receive and support the internal combustion engine. The axis of rotation of the power output shaft is provided at a fixed first distance from the top of the support base. The top of the support base has a laterally spaced second end 80. The second end is adapted to receive and support a preselected driven device. The axis of rotation of the power input shaft is provided at a fixed second distance from the flat top of the support base. The fixed second distance is equal to the first distance. Fasteners for the driven devices are illustrated as threaded adjustment bolts 82 at each corner. Such fasteners are adapted to be bolts or other quick release fasteners. They function to attach a selected driven device to posts 84 extending from the universal base. Such components are of specialized designs to insure proper elevational height and axial alignment of the power input shaft with respect to the power output shaft. The lateral distances between the internal combustion engine and the preselected driven device are such as to axial align the apertures of the power output shaft with the aperture of the power input shaft.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A power coupling system having a horizontal axis for facilitating the powering of a pressure sprayer, generator and air compressor by an internal combustion engine in a safe, convenient and economical manner comprising, in combination:

an internal combustion engine having below a base and above an exterior face and an opposed interior face, the exterior face having a handle adapted to be pulled by a user for rotation about a fixed horizontal major axis of rotation to start the operation of the internal combustion engine, the interior face having a power output shaft adapted to be rotated about a fixed horizontal axis of rotation coextensive with the major axis of rotation in response to the operation of the internal combustion engine, the power output shaft having a free end of an enlarged cylindrical configuration constituting a power take off shaft and formed with a laterally spaced plates, the plates having axially aligned circular apertures there through in axial alignment with a common minor axis perpendicular to and intersecting the major axis of rotation;

a plurality of driven devices including a pressure sprayer, a generator and an air compressor, each driven device having a power input shaft mounted for rotation about a fixed horizontal major axis of rotation coextensive with the horizontal major axis of rotation of the power output shaft and a rectangular base having holes and a fastener at each corner, the power input shaft having a free end formed with a flat projection positionable between the plates of the power output shaft, the flat projection having an aperture in axial alignment with the apertures of the plates of the power output shaft, the power input shaft having a cylindrical section adjacent to the projection with a diameter essentially equal to the diameter of the cylindrical section of the power output shaft;

a bolt having a first end with an enlarged head and a second end with male threads and with a central extent there between, the central extent extending through the apertures of the power input shaft and power output shaft for operatively coupling the internal combustion engine and any of the driven devices, the bolt having an associated nut with female threads removably positioned on the threads of the bolt to allow a user to selectively interchange the driven devices; and a universal support base designed to accommodate the interchangeable driven devices and fabricated of a rigid metallic material with a horizontal bottom positionable upon a recipient surface and a horizontal top parallel with the bottom, the top of the support base having a first end adapted to permanently receive and support the internal combustion engine with the axis of rotation of its power output shaft at a fixed first distance from the top of the support base and a laterally spaced second end including posts extending from the horizontal top into said holes in the rectangular base of a preselected driven device with the axis of rotation of its power input shaft at a fixed second distance from the flat top of the support base, the fixed second distance being equal to the first distance, and the lateral distances between the internal combustion engine and the preselected driven device being such as to axial align the apertures of the power output shaft with the aperture of the power input shaft.

* * * * *